United States Patent [19]

Vegiard

[11] Patent Number: 4,735,221

[45] Date of Patent: Apr. 5, 1988

[54] WASH SHIELD FOR PAINT ROLLER

[75] Inventor: Lucien Vegiard, Madeira Beach, Fla.

[73] Assignee: Walter J. Monacelli, St. Petersburg, Fla. ; a part interest

[21] Appl. No.: 886,819

[22] Filed: Jul. 18, 1986

[51] Int. Cl.[4] ..... B08B 3/02

[52] U.S. Cl. ..... 134/138; 134/183; 134/157; 68/213

[58] Field of Search ..... 134/137, 138, 139, 140, 134/141, 148, 149, 157, 182, 183; 68/213

[56] References Cited

U.S. PATENT DOCUMENTS

| | | | |
|---|---|---|---|
| 2,725,065 | 11/1955 | Wilsing | 68/213 X |
| 2,938,368 | 5/1960 | Bixel | 134/138 X |
| 3,037,516 | 6/1962 | Leach | 134/138 |
| 3,075,534 | 1/1963 | Habostad | 134/138 |
| 3,126,899 | 3/1964 | Caywood | 134/139 X |
| 3,139,891 | 7/1964 | Faustman | 134/138 |
| 4,142,540 | 3/1979 | Vegiard | 134/138 |
| 4,641,673 | 2/1987 | Conley et al. | 134/138 |

FOREIGN PATENT DOCUMENTS

| | | | |
|---|---|---|---|
| 2355843 | 5/1975 | Fed. Rep. of Germany | 134/139 |
| 2360884 | 6/1975 | Fed. Rep. of Germany | 134/138 |
| 825367 | 10/1969 | United Kingdom | 134/139 |

*Primary Examiner*—Harvey C. Hornsby

*Assistant Examiner*—Frankie L. Stinson

*Attorney, Agent, or Firm*—Walter J. Monacelli

[57] ABSTRACT

The wash shield disclosed herein comprises a sheet material in substantially cylindrical shape having a slot running parallel to the axis of the cylinder, in which cylindrical shape a paint roller may be enclosed while a stream of wash water is directed to the surface of the roller for the purpose of removing paint therefrom. This improved wash shield has a support or centering means against which a corner of the handle of the paint roller may be pressed or abutted so as to position the axis of the roller in a desired location inside the wash shield. This centering means may be attached to and extended from the side wall of the shield or where the shield has a cover, this centering means may be situated on the inside surface of this cover. Such a cover may be at one end of the cylinder which is at the top when the cylinder is held in a vertical position, and the opposite end or bottom end is open and extends about 0.75 inch or more beyond the end of the roller contained therein. The force of the wash stream rotates the roller very rapidly and the resultant centrifugal force throws the wash water and accompanying paint away from the roller and against the interior of the cylindrical shield and from there the wash liquid falls vertically and out the open end of the shield.

11 Claims, 3 Drawing Sheets

WASH SHIELD FOR PAINT ROLLER

BACKGROUND OF THE INVENTION

1. Field of the Invention

This invention relates to a shield device used in washing paint off a roller after the roller has been used in applying paint to a surface. More specifically, the shield device protects against the wash water and removes paint from spraying onto surrounding surfaces while the paint is being removed by directing a stream of wash water against the roller surface. Still more specifically, this shield device is particularly designed to hold the roller in a central position in the washing shield.

2. State of the Prior Art

Generally in washing the paint off a paint roller after painting is finished, the roller is immersed over and over again in a bucket or buckets of water or a stream from a water hose is directed against the roller while the roller is held in an open area where the resulting spray will not harm the surroundings. These methods are rather messy and, in some cases, the worker prefers to discard the roller without going through the cleaning process. Consequently, if the worker does not wish to go through such a messy cleaning operation, he has to use a new roller for the next painting operation.

Applicant was granted U.S. Pat. No. 4,142,540 on Mar. 5, 1979 entitled "Wash Shield For Paint Roller". The sheet material shield described therein has a first slot running substantially parallel to the linear axis of the shield; a second slot extending perpendicularly from said first slot and running only a short distance around the cylindrical surface of the shield; a handle attached to the sheet and positioned adjacent to this second slot and adapted to support the handle of a roller positioned in said shield and an end plate or cover closing the end of the shield adjacent to the second slot.

The references cited against this patent were Caywood U.S. Pat. Nos. 3,126,899; Habostad 3,075,534; George 3,577,280 and Italian Pat. No. 250,197.

In the shield covered by this patent there is a problem in positioning the axle of the roller near the longitudinal axis of the shield and thereby sufficiently spaced from the side wall of the shield. This problem is emphasized by the fact that the paint rollers available commercially have a variety of shapes in the handles extending from the paint rollers.

STATEMENT OF THE INVENTION

In accordance with the present invention, it has now been found that the washing of a paint roller may be very simply, quickly and efficiently effected by a washing shield comprising a sheet material, such as metal, plastic, etc., shaped in substantially cylindrical form, having a slot parallel to the axis of the cylinder through which the handle of the roller may be passed when the roller is being inserted into the cylinder. This slot is sometimes referred to as the "vertical" slot since the axis of the cylinder is generally in a vertical position during use. The cylinder advantageously has a cover at one end thereof and the opposite end is advantageously open or at least has an exit for the wash liquid. At or near the end of the cylinder at which the cover is attached there is a slot running perpendicularly from the first or "vertical" slot and this may be referred to as the "horizontal" slot since it is generally in a horizontal position during use. The shield of this invention differs from that of U.S. Pat. No, 4,142,540 primarily in that a centering means is provided to maintain the axle of the roller being washed substantially near the axis of the shield or at least substantially spaced from the sidewall of the shield. This centering means may be attached to or extend downward from the cover at the top end of the shield where such a cover is provided or may be supported by and extending from the sidewall of the shield. Where there is a cover in the shield having the centering means supported by the sidewall, this centering means may be adjacent to the cover or substantially spaced from the cover.

When a paint roller is to be cleaned, the device may be held in a vertical position and the narrow part of the handle fitted into the vertical slot while the roller is raised vertically into the interior of the cylindrical shape. When the narrow part of the handle reaches the point where the vertical slot is joined by the horizontal slot, the handle is moved horizontally into that slot. The handle of the roller extends at a 90° angle or right angle from the axle portion on which the roller rotates. This right angle or "corner" of the roller handle is pressed against the centering means of the shield so as to maintain the roller in a position at or near the linear axis of the shield. A portion of the roller handle extending beyond the said right or "corner" may be pressed against the handle as shown in U.S. Pat. No. 4,142,540 or may be held in a groove or clip attached to the sidewall of the shield. Then a stream of water is directed at the roller through the vertical slot. The force of the stream striking the roller tangentially causes the roller to rotate rapidly, thereby throwing water and paint by centrifugal force off the roller and onto the interior surface of the cylindrically shaped shield. After the impact of the liquid against the shield sidewall, the liquid falls vertically downward toward the open or exit end of the device.

The cylinder may have a handle attached thereto so that it may be held in one hand while the other hand holds the water hose. Advantageously the shield handle is attached vertically with one end of the handle near the horizontal slot. In this way the narrow part of the paint roller handle emerging through the horizontal slot may be pressed by the holder's thumb or finger against the shield handle or there may be a clip into which the roller handle is pressed and held in position. This permits the roller to be held rigidly during its rapid rotation.

In a preferred modification the handle of the roller is used also as a handle to hold the shield. This may be effected by having a clip attached to the side of the shield into which the roller handle is firmly clasped, or such a clip may be an extension of the means extending downward from the top of the shield which serves to hold the roller centrally positioned within the shield.

If desired, the shield handle or similar holding device may be clamped to any appropriate holding means so that the cylinder and the roller handle may be held firmly during the washing operation.

Alternatively, the device may be used without a handle and the device fitted tightly into an opening in a horizontal sink such as a table top or a board or top on a sink so that the device is held rigidly in the opening and the wash liquid emptied below the surface embracing the device, such as in a sink or drain.

Advantageously also one edge of the vertical slot may be turned inwardly to catch or impede any spray that might otherwise exit through the slot, particularly if the slot is made of any considerable width.

The device of this invention may be further described by reference to the drawings in which.

Figure 1:
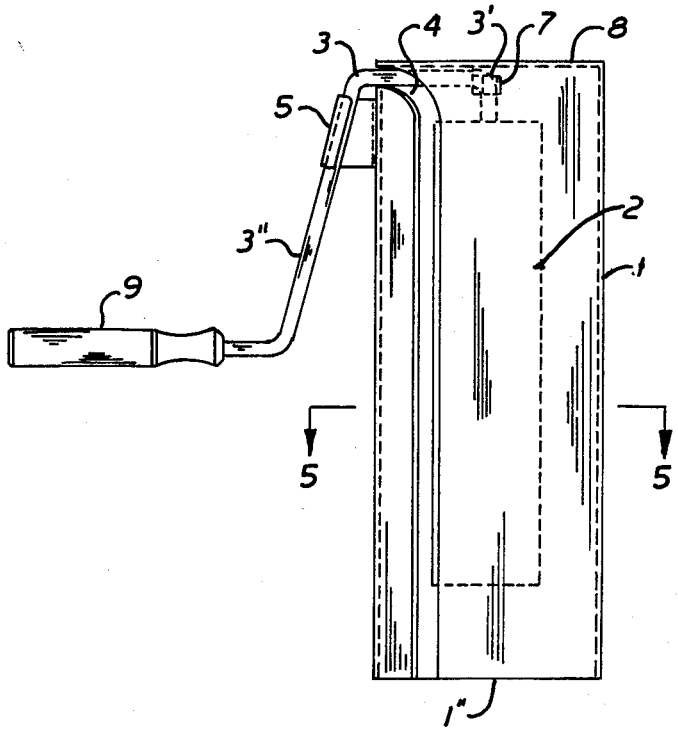
FIG. 1 is a front elevational view of a preferred modification of the paint roller wash shield of this invention with a paint roller inside the shield.

More specifically FIG. 1 shows shield 1 which has paint roller 2 inside the shield with roller handle 3 extending outside the shield through horizontal slot 4 and held firmly in position by clip 5 which is attached to shield in a position adjacent to horizontal slot 4. Vertical slot 6 provides an entry for the handle 3 to be moved upward in the shield and then horizontally in slot 4 so that a right angle part 3' of the handle 3 can be positioned in abutting relationship with centering means 7 positioned at the inside of top 8 of the shield, after which a slanted portion 3" of handle 3 can be clamped inside clip 5 to fix the roller handle 3 in a firm fixed relationship with the shield 1. Hand grip 9 is provided to facilitate the operator's hold on the combination of roller and shield.

Figure 2:
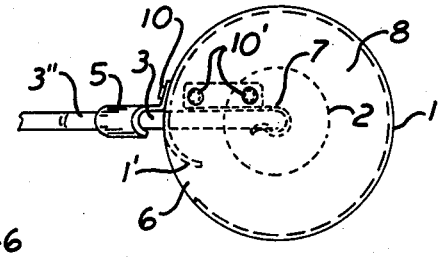
FIG. 2 is a plan or top view of the shield of FIG. 1.

FIG. 2 shows a top view of the combination of FIG. 1 with only a partial view of handle 3" with clip 5 holding the handle of roller 2 in a firm position with the right angle handle portion 3' joining handle 3 with roller axle 11 positioned firmly against centering means 7. Shield portion 1' adjacent to vertical slot 6 is bent inward into the shield to guide water, paint and spray of the same back into the interior of the shield thereby to guard against exit of the same from the inside of the shield. The bottom 1" of shield 1 is open so that water used to wash the roller is allowed to exit together with paint removed from the roller.

Figure 3:
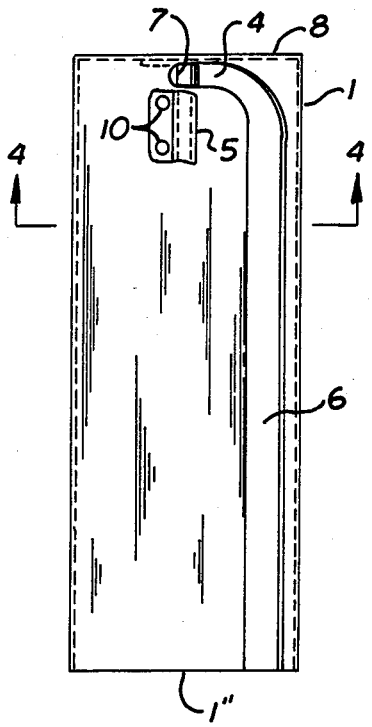
FIG. 3 is a side elevational view of the shield of FIG. 1 with the roller omitted.

FIG. 3 gives a better view of the arrangement of vertical slot 6 and horizontal slot 4 so that the handle of the roller may be moved upward in slot 6 and then horizontally in slot 4 so that the axle 11 of the roller at its right angle connection 3' with handle 3 may be positioned firmly against centering means 7. Clip 5 for holding handle portion 3" is shown fastened to shield 1 by rivets 10.

Figure 4:
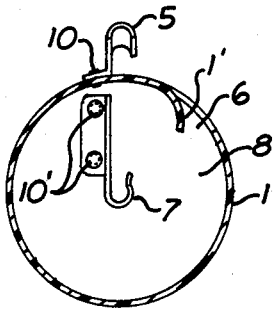
FIG. 4 is a cross-sectional view of the shield of FIG. 3 taken at line 4—4.

FIG. 4 shows an upward cross-sectional view of the shield of FIG. 3 with centering means 7 held to the inside of top cover 8 by means of rivets 10'.

Figure 5:
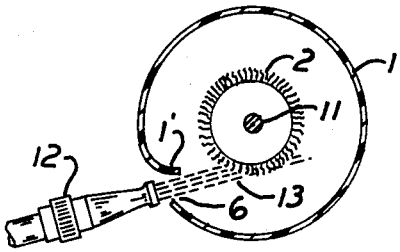
FIG. 5 is a cross-sectional view of the shield and roller of FIG. 1 taken at line 5—5.

FIG. 5 shows a cross-sectional view of the combination of FIG. 1 with water nozzle 12 directing a jet or stream of water through vertical slot 6 and striking roller 2 tangentially so as to effect fast rotation of roller 2 causing centrifugal removal of water and paint from the roller. The curvature shown for shield portion 1' is an aid in preventing spray between roller 2 and shield 1 from exiting through vertical slot 6.

Figure 6:
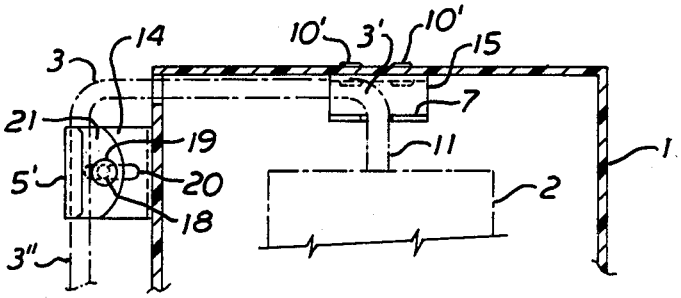
FIG. 6 is a sectional view of another modification of the shield of this invention showing alternate holding clips.

FIG. 6 is a partial cross-section of a modification of the top of shield 1 which has optional variations in the structure of centering means 7 and clip 5 with roller 2, axle 11 and handle 3 shown in phantom. Centering means 7 is shown in greater detail in FIG. 7 and the adjustable clip 5' is shown in greater detail in FIG. 8.

Figure 7:
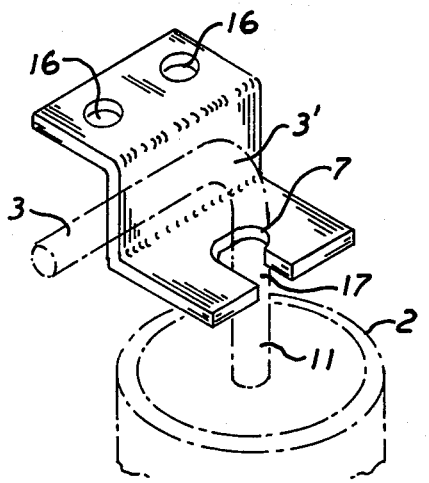
FIG. 7 shows a modification of the means for holding the axle of a paint roller at a central location.

FIG. 7 shows a bracket 15 which may be attached to the inside of cover 8 of shield 1 by rivets, plastic plugs, etc., pushed into openings 16 and corresponding openings in the top 8 of the shield. The axle 11, roller 2 and handle 3 are shown in phantom. Slot 17 of the bracket allows for passage of the axle 11 into position against center means 7.

Figure 8:
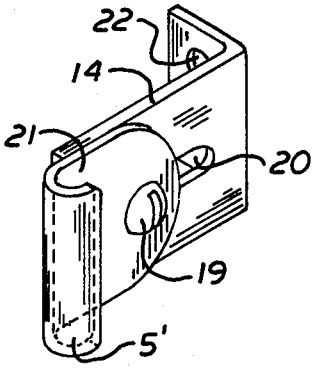
FIG. 8 shows a modification of the outside clip to accommodate different roller handles.

In FIG. 8 adjustable clip 5' can be moved to various angles by turning the clip on bolt 18 which can be slid in slot 20 to accommodate a tight fit on handle portion 3". A wingnut (not shown) on the opposite side of bolt 18 from bolt head 19 can be turned to tighten the flat portion 21 of clip 5' against bracket 14. Openings 22 (one not shown) are provided for riveting or bolting of bracket 14 to shield 1 in a position adjacent to the horizontal slot 4.

Figure 9:
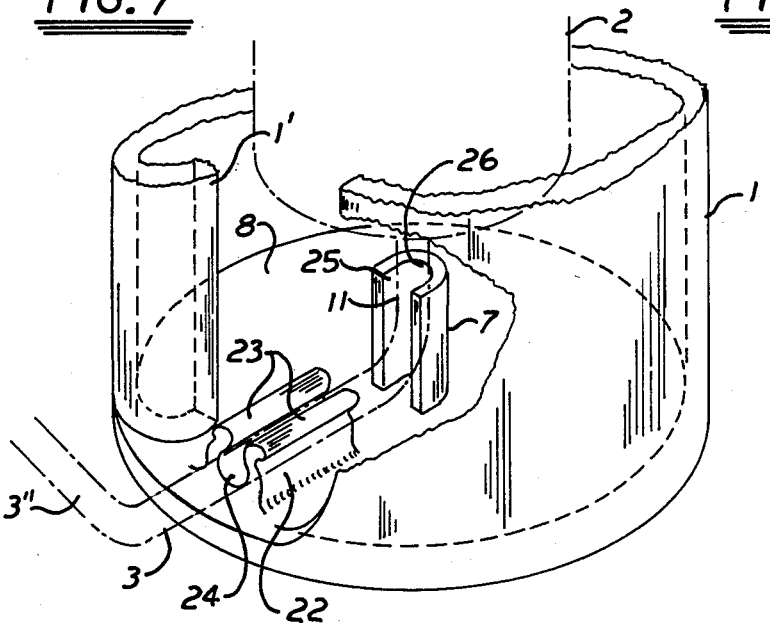
FIG. 9 shows an upside down view of the interior of the top of a shield in which plastic brackets have been molded into the top of a one-piece molded shield which provides both a bracket or clip for the handle and a center-locating means.

FIG. 9 shows an upside-down view of the inside of the top section of a modification of the shield on this invention in which molded centering means 7 and clipping means 22 for firm holding of handle 3 are molded integrally with plastic shield top 8. Roller 2, axle 11, handle 3, right angle handle portion 3' and handle portion 3" are shown in phantom. The centering means 7 has groove 25 which permits axle 11 to enter the centering means and rest against abutment portion 26. The grooved portion 25 is made long enough and tight fitting enough on axle 11 and right angle portion 3' to prevent sideway swivelling of axle 11. Clipping means 22 is also designed to give a tight fit on handle 3 and to prevent rotation of arm 3 on axle 11. Clipping means 22 has groove 24 of appropriate size to give a tight fit on handle 3. Lips 23 are spaced from each but close enough to require spreading apart in order for the handle 3 to enter groove 24 and after the handle is settled in the groove, lips 23 press onto handle 3 to hold it into position. Obviously the plastic material of clipping means 22 should have sufficient resiliency to allow this tight fitting.

Figure 10:
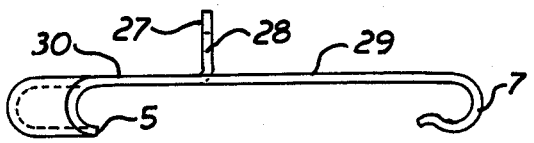
FIG. 10 is a top view of an integrated or one piece combination centering and holding means adapted for attachment only to the side of the shield.

FIG. 10 is a top view of a one-piece combination of centering and holding means which can be attached to the side only of the shield. This can be used without any attachment to the top of the shield and also in shields which do not have a top as shown in FIGS. 13 and 14.

Clipping or holding means 5 is at one end and centering means 7 is at the opposite end of this combination device. Flange 27 extends from arm 30 and provides the means for fastening to the side of the shield by rivets through openings 28.

Figure 12:
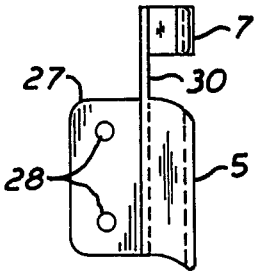
FIG. 12 is a front elevational view of the centering and holding means of FIGS. 10 and 11 looking toward the closer centering means and the farther holding means.
Figure 11:
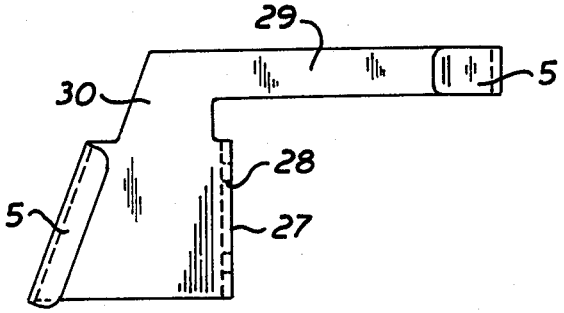
FIG. 11 is a side elevational view of the combination centering and holding means of FIG. 10.

FIG. 11 is a side view and FIG. 12 is a front view of this combination piece. The front view is with the centering means 7 closer to the viewer and the clipping or holding means 5 farther from the viewer.

Figure 13:
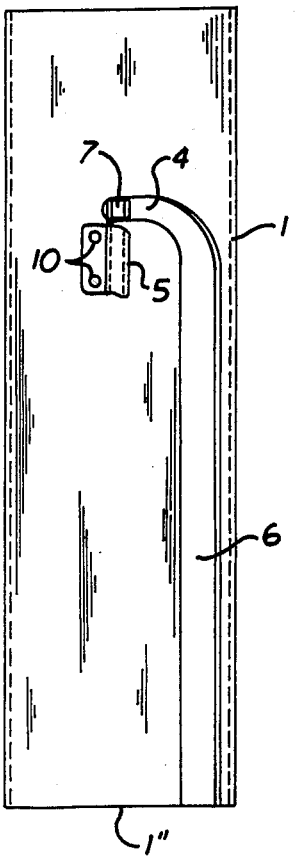
FIG. 13 is a front elevational view of a shield of this invention with an open top and using the combination of holding and centering means of FIGS. 10 and 11.
Figure 14:
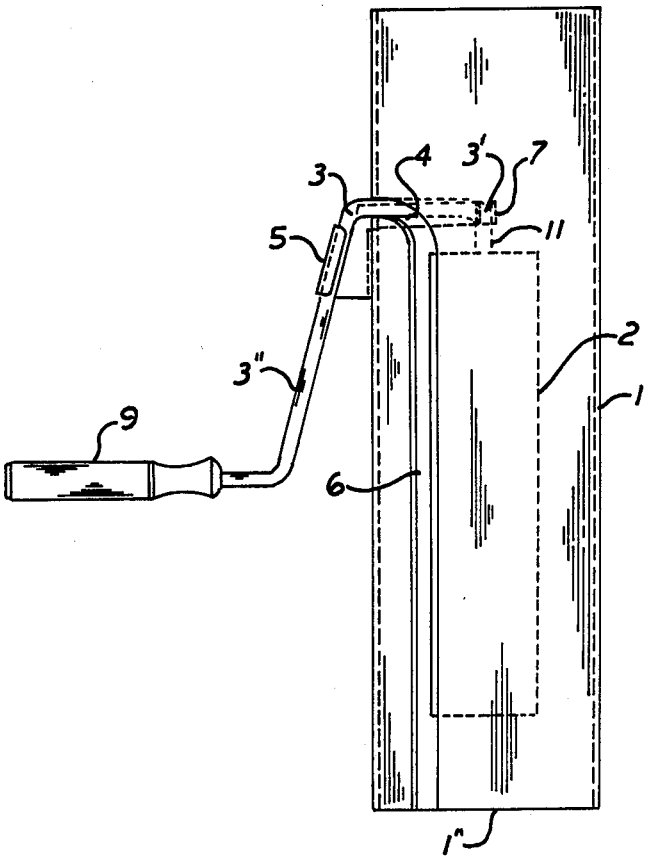
FIG. 14 is a side elevational view of the shield of FIG. 12 with a paint roller positioned therein.

FIGS. 13 and 14 show a shield which has no top and therefore has a greater length or height above the horizontal slot 4 to reduce the possibility of having spray coming out of the open top. FIG. 13 is a front elevational view and FIG. 14 is a side elevational view with a roller inserted in the shield. This combination holding and centering device may also be used in shields having tops such as the shields shown in FIGS. 1 and 3. Because of the greater strength and rigidity required in the combination device, it is generally desired to have this made of suitable metal.

For economic reasons when the shield is molded of plastic, it is desirable to mold the entire shield with centering means and clipping or holding means integral with the main part of the shield. In such cases all parts may be made of the same plastic composition or a lighter material may be used for the main shield portion including the top, and plastic of related but more dense or durable characteristics may be used for the centering and clipping means. It is also possible to mold the centering and clipping means of stronger or more durable plastic material, or to make those of metal and then to rivet or bolt these to the main portion of the shield. It is also possible to have protruding portions or bolts integrally molded in the centering and clipping means which snap into openings into the top and side respectively of the shield. In such cases appropriate tapering and bulges in the protrusions are provided to give easy entry and eventual tight fitting.

It is desirable to have sufficient length of the centering means 7 (FIG. 2) which is between rivets 10' and 10' as to prevent any liquid or spray that is swirling around the top inside of the shield to be stopped and to cause the liquid to drop downward.

In FIG. 5 the jet stream 13 is shown to strike roller 2 on its right side so as to cause counterclockwise rotation of the roller as viewed looking downward from above the roller. In this case the curved edge 1' of the vertical opening 6 is on the left side of the vertical opening. It is also contemplated that the curved edge 1' may be on the right side of the vertical opening in which case jet stream 13 is directly against the left side of roller 2 so as to give a clockwise spin or rotation to roller 2 and curved edge 1' will be in appropriate position to guard against the exit of spray through opening 6.

While the description above for use of the shield of this invention has been directed to the use of a jet stream of water for removing latex paint from a roller, which paint is more miscible with water, it is also possible to use the device of this invention for removing oil-based paints from rollers by using a jet stream of an appropriate solvent such as hydrocarbon solvents, i.e., turpentine, naphtha, etc. In such cases, for economic reasons, the solvent is collected and saved for subsequent reuse.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The invention claim is:

1. In a shield for washing paint from a rotatable paint roller having a handle, a narrow arm portion and an axle about which the said roller is rotatable comprising (a) a sheet material shaped in substantially cylindrical form having a first slot and a second slot therein, said first slot running substantially parallel to the linear axis of said cylindrical form and said cylindrical form having a length extending beyond the length of the paint roller to be washed, said first slot having a width sufficient to accommodate the passage of the said narrow arm portion and to permit the passage of wash stream therethrough whereby said wash stream impinges tangentially on said roller and rotates and washes paint from said roller, said second slot being positioned close to one end of said cylindrical form and running perpendicularly from said first slot and only a short distance around the curved surface of said cylindrical form, said second slot being adapted to accommodate the said narrow arm portion of said paint roller during said washing, said cylindrical form having an end plate closing said cylindrical form at the end thereof adjacent to said second slot with the opposite end of said cylindrical form being open to allow the flow of wash water from said shield, and (b) a holding means attached to said cylindrically formed sheet material and positioned adjacent to said second slot, said holding means being adapted to support said shield and to have the paint roller handle pressed into contact therewith and thereby to hold and support said roller during said washing; the improvement comprising (c) a centering means for holding the axle of said roller near the axis of said cylindrical form, said holding means comprising a clip into which said narrow arm portion of said roller is snapped to hold the said axle pressed against the said centering means, and said centering means is affixed to the under side of said end plate.

2. The shield of claim 1 in which said centering means and said clip are integrated in a single piece which is fastened to the side of said cylindrical form near said second slot.

3. The shield of claim 2 in which said single piece is also affixed to the said end plate.

4. The shield of claim 3 in which one edge of said first slot is turned inward toward the center of said cylindrical form and is thereby adapted to prevent the exit of spray through said first slot.

5. The shield of claim 1 in which said centering means and said clip are integrated in a single piece which is fastened to the side of said cylindrical form near said second slot.

6. The shield of claim 1 in which one edge of said first slot is turned inward toward the center of said cylindrical form and is thereby adapted to prevent the exit of spray through said first slot.

7. The shield of claim 1 in which said clip is also affixed to the under side of said end plate.

8. The shield of claim 1 in which the said centering means has a groove therein of sufficient length and size to provide a tight grip on the said axle of said roller and to prevent any swivelling motion of said axle.

9. The shield of claim 8 in which said clip is also affixed to the under side of said end plate.

10. The shield of claim 9 in which said shield is made of molded plastic and said clip and said centering means are integrally molded with said end plate.

11. The shield of claim 1 in which said shield is made of molded plastic and said centering means is integrally molded with said end plate.

* * * * *